US006073302A

United States Patent [19]

Buscher

[11] Patent Number: 6,073,302

[45] Date of Patent: Jun. 13, 2000

[54] DETECTION MEANS FOR FILTER MEANS IN VACUUM CLEANERS

[75] Inventor: Thomas Buscher, Dietenhofen, Germany

[73] Assignee: Branofilter GmbH, Dietenhofen, Germany

[21] Appl. No.: 09/123,841

[22] Filed: Jul. 28, 1998

[30] Foreign Application Priority Data

Aug. 7, 1997 [DE] Germany ..... 197 34 193

[51] Int. Cl.[7] ..... A47L 9/28

[52] U.S. Cl. ..... 15/339; 15/319; 96/404; 96/418

[58] Field of Search ..... 15/319, 339, 347, 15/331; 55/DIG. 2, DIG. 3; 96/403, 404, 417, 418, 423

[56] References Cited

U.S. PATENT DOCUMENTS

| | | | |
|---|---|---|---|
| 2,839,156 | 6/1958 | Martinec . | |
| 4,184,225 | 1/1980 | Leinfelt . | |
| 4,245,370 | 1/1981 | Baker . | |
| 5,378,254 | 1/1995 | Maly et al. | 96/418 |
| 5,472,460 | 12/1995 | Schmierer . | |
| 5,472,465 | 12/1995 | Schmierer . | |
| 5,674,381 | 10/1997 | Dekker | 96/417 |
| 5,810,908 | 9/1998 | Gray et al. | 96/417 |
| 5,867,863 | 2/1999 | McCormick | 15/347 |
| 5,907,886 | 1/1999 | Buscher | 96/423 |
| 5,920,043 | 7/1999 | Wang et al. | 15/339 |

FOREIGN PATENT DOCUMENTS

| | | | |
|---|---|---|---|
| 26 55 547 | 6/1978 | Germany . | |
| 34 34 209 | 9/1984 | Germany . | |
| 3918237 | 12/1990 | Germany | 15/339 |
| 41 10 683 | 10/1992 | Germany . | |
| 43 39 297 | 9/1994 | Germany . | |
| 43 39 298 | 9/1994 | Germany . | |
| 196 05 780 | 8/1997 | Germany . | |
| 26 03 110 | 8/1997 | Germany . | |
| 01 313032 | 2/1990 | Japan . | |
| 02 131732 | 8/1990 | Japan . | |
| 40-5 154072 | 6/1993 | Japan | 15/339 |
| 05 184497 | 11/1993 | Japan . | |
| 1 440 174 | 6/1976 | United Kingdom . | |

*Primary Examiner*—Terrence R. Till
*Attorney, Agent, or Firm*—Flynn, Thiel, Boutell & Tanis, P.C.

[57] ABSTRACT

A detection means for filter means in vacuum cleaners, into which in addition to a vacuum cleaner bag at least one additional filter is able to be inserted. It comprises a sensor means responsive to the filter means inserted into said vacuum cleaner and switch means controlled by said sensor means for preventing switching of the vacuum cleaner motor if said filter means is not correctly recognized. The at least one electronic sensor means responsive to a detectable element in or on at least one additional filter by means of electromagnetic waves is connected with the switching means via an evaluating or processing means, adapted to check the correct position and design of the at least one detectable element. The renders possible not only the checking of the presence of an additional filter in the vacuum cleaner but furthermore its right placement and the right design for the respective vacuum cleaner so that impairment of and damage to the vacuum cleaner due to fitting the wrong additional filter may be avoided.

26 Claims, 3 Drawing Sheets

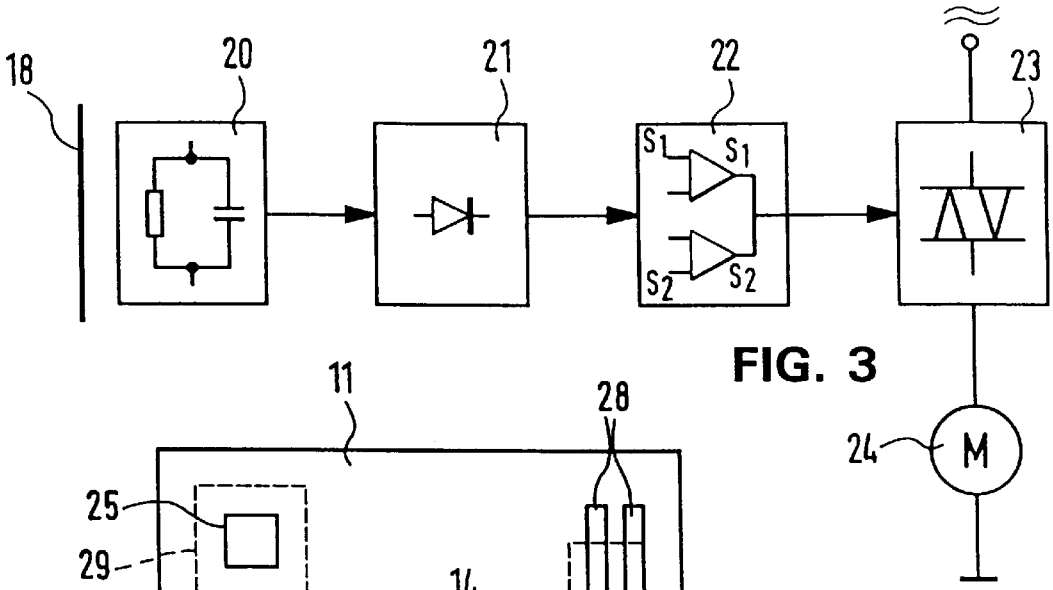
FIG. 3
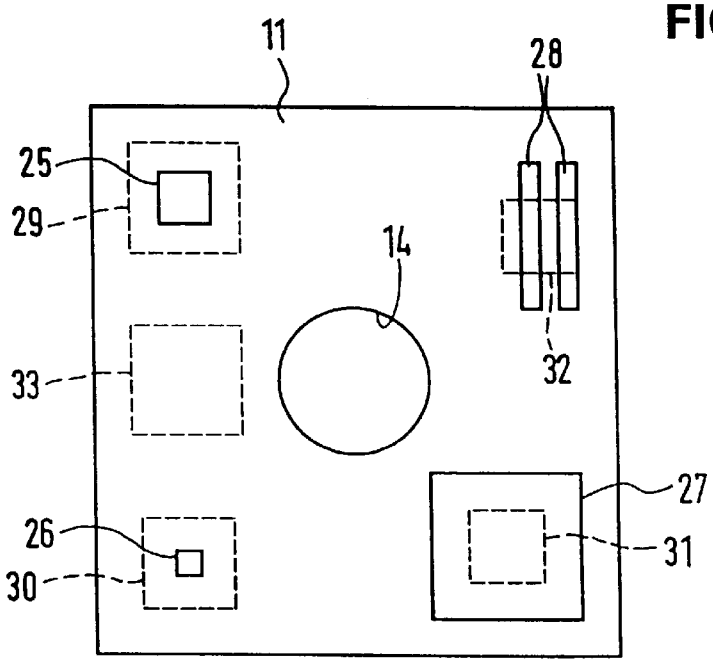
FIG. 4
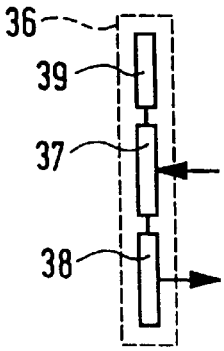
FIG. 5
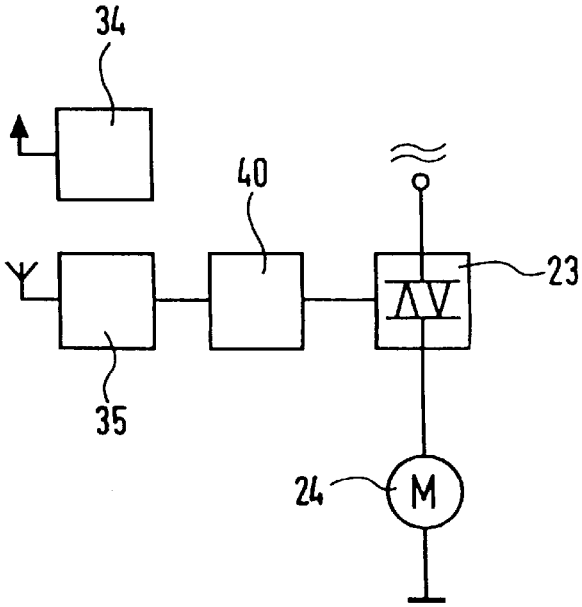

DETECTION MEANS FOR FILTER MEANS IN VACUUM CLEANERS

BACKGROUND OF THE INVENTION

The invention relates to a detection means for filter means in vacuum cleaners, into which in addition to a vacuum cleaner bag at least one additional filter is able to be inserted, comprising a sensor means responsive to the filter means inserted into said vacuum cleaner and switch means controlled by said sensor means for preventing switching on of the vacuum cleaner motor if said filter means is not correctly recognized.

THE PRIOR ART

The German patent publication 2,603,110, the German patent publication 3,434,209 and the U.S. Pat. No. 2,839,156 each disclose such a detection means, in the case of which the connection member of the vacuum cleaner bag inserted into the vacuum cleaner actuates a switch so that in this manner the presence of the vacuum cleaner bag is recognized. It is only when the switch is actuated that the vacuum cleaner motor can be switched on. Furthermore the German patent publication 2,655,547, the British patent publication 1,440,174 and the U.S. Pat. No. 4,184,225 disclose pneumatic arrangements in the case of which the presence of the vacuum cleaner bag is detected pneumatically and in the case of which it is only in the case of detection of a vacuum cleaner bag that switching on of the vacuum cleaner motor is possible.

Although the known detection means do render it possible to prevent switching on of the motor when the filter bag is not inserted, there is however the danger of the wrong additional filter being inserted leading to the likelihood of operational failure occurring.

SHORT SUMMARY OF THE INVENTION

One object of the invention is to provide a detection means of the type initially mentioned by means of which not only switching on of the vacuum cleaner without an additional filter being fitted but also switching on with the wrong or a wrongly inserted additional vacuum cleaner bag may be prevented effectively.

In order to achieve these and/or other objects appearing from the present specification, claims and drawings, in the present invention the at least one electronic sensor means responsive to a detectable element in or on at least one additional filter by means of electromagnetic waves is connected with the switching means via an evaluating or processing means, adapted to check the correct position and design of the at least one detectable element.

The detection means of the invention means that switching on of the vacuum cleaner is reliably prevented when the wrong additional filter is mounted, even if such wrong inserted additional filter possesses a shape, which corresponds to that of the correct additional filter. If an unsuitable additional filter of inferior quality or one unable to fit properly owing to it having the wrong dimensions while chancing to possess the same geometry is used, such additional filter, which for instance is a micro-filter, cannot fulfill and comply with the promised performance in the case of an overly coarse filtering action, something likely to lead to complaints and customer dissatisfaction. Furthermore insufficient passage of dust through an overly dense, incorrect additional filter may lead to an impairment of the vacuum cleaner's performance or even to damage to the vacuum cleaner motor. With the detection means in accordance with the invention it is possible for the correct additional filter to be reliably detected or recognized so that optimum operation as a vacuum cleaner is maintained and disadvantages through having overly large or small pores in the filter are avoided. In addition such detection means can reliably detect a wrongly inserted additional filter or the absence of a filter. Furthermore as regards the ever increasing requirements of product liability the detection means in accordance with the invention turns out to be extremely advantageous.

It is convenient for the sensor means to also be designed to additionally be responsive to a detectable element in or on the vacuum cleaner bag or of the plate-like connection member and to check the correct position and design of the same. As a result the protective means of the vacuum cleaner and the guarantee of reliable operation is still further improved.

Owing to the provision of at least the sensor means and the evaluating means and preferably furthermore of the switching means in the form of a structural unit on at least one printed circuit board and/or the design in the form of an integrated circuit the detection means of the invention can be produced without structural changes being necessary to depart from the design of conventional vacuum cleaners or, respectively, vacuum cleaner housings. The structural unit can in a simple and economic manner be arranged in or on a wall of the vacuum cleaner housing operatively adjacent to the at least one detectable element, the wall provided with the structural unit of the vacuum cleaner housing being arranged essentially directly adjacent to the at least one detectable element.

For producing the electromagnetic waves the sensor means advantageously possesses at least one transmitter more particularly having an oscillating circuit, the sensor signals being formed owing to the return action of the detectable element on the transmitter and/or the electromagnetic waves. In this manner the sensor means will react extremely reliably to the configuration and design of the sensor element so that the additional filter having such detectable element, or, respectively, the connection member designed in this manner, in the respective vacuum cleaner bag may be reliably recognized.

In accordance with a first, extremely advantageous embodiment the detectable element is designed in the form of a metallic sheet element and more especially as a metal plate or foil or layer, and the sensor signals are formed in a manner dependent on the eddy current damping of the transmitter. The provision of such a metallic sheet element on or in the additional filter and if required the connection member as well, may in this case be performed extremely economically, variations in the respective area and the respective configuration being possible in a simple manner.

For evaluation the detectable element in the evaluating means is set for a certain amplitude of the oscillation of the oscillating circuit, the threshold value stage being provided for recognition in the evaluating means, such stage receiving a signal derived from the amplitude of the oscillation of the oscillating circuit, switching on of the vacuum cleaner motor being prevented above an adjustable first threshold value. Therefore as from a certain area of the detectable element, that is to say as from a certain degree of damping the prevention of switching on is overridden.

Even more reliable recognition of the correct additional filter or, respectively, vacuum cleaner bag is achieved if additionally below a second adjustable lower threshold value the switching of the vacuum cleaner motor is prevented. This means that, for instance, an additional filter, which may be coated with a metallic foil or comprises metallic components, cannot be recognized as being correct.

In another advantageous embodiment the detectable element possesses means for return transmission of signals which represent a modified form of the received electromagnetic waves, the sensor means possessing a suitable receiving means. The means that there is an even greater degree of reliability of recognition. The modified signals may in this case have a changed frequency and/or phase relationship or they may comprise a signal code. In the evaluating means corresponding recognition means are provided for returned signals modified in a predetermined manner.

Such a detectable element, which involves sophisticated and advanced technology, is preferably designed in the form of a micro-chip, which may for instance be readily arranged between different layers of the additional filter, or respectively, connection member and is able to be manufactured on a mass scale relatively economically.

In a further alternative design in accordance with the invention the transmitter may be designed in the form of a light transmitter and the detectable element can be an element adapted to return the light to a light receiver in the sensor means. As a detectable element a barcode element or a deflecting element adapted to return the light changed or unchanged at a particular position in the sensor means is suitable.

As a further advantageous design it is possible for capacitive detection of the detectable element to be provided for.

In order more particularly in the case of extremely simple designs of detectable elements (as for instance a metallic sheet element) to ensure extremely reliable recognition of the correct additional filter or furthermore the connection member or, respectively, filter bag, a plurality of detectable elements are arranged on or in the at least one additional filter and preferably also additionally on or in the connection member and/or the vacuum cleaner bag and are able to be sensed by a corresponding number of sensor part means of the sensor means.

The at least one additional filter is preferably a micro-filter and/or a filter cassette and/or an active carbon filter and/or combined filter as a combination of the above mentioned filters. In this respect only one additional filter or furthermore a plurality of different additional filters may be provided.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

FIG. 3 shows a block circuit diagram of a first embodiment with a detectable element in the form of a metallic sheet element.

FIG. 4 shows an arrangement of such various different detectable elements on a connection member of an additional filter in plan view.

FIG. 5 is a block circuit diagram of a second embodiment of the invention, in the case of which the detectable element returns the received electromagnetic waves back in a modified form.

DETAILED ACCOUNT OF WORKING EMBODIMENTS OF THE INVENTION

Figure 1:
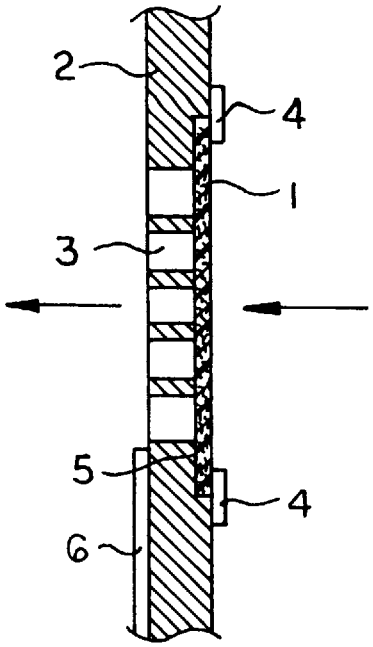
FIG. 1 is a simplified sectional view of an additional filter arranged on part of the housing of a vacuum cleaner.

The additional filter 1 illustrated diagrammatically in FIG. 1 is for example a micro-filter and comprises a plate-like filter body of a plastic fiber batt, plastic fiber fabric or some other filter material. As plastics it is possible to employ for instance polypropylene or polyester.

On a wall 2 illustrated in part of a vacuum cleaner 44 (FIG. 6) a grid-like opening 3 is provided in a housing wall 2, which is covered over by the additional filter 1. For this purpose the wall 2 possesses a recess corresponding to the shape of the additional filter 1, in which the additional filter 1 is held by lugs 4. It is possible for the flexible additional filter 1 to be inserted in these lugs 4. It is possible for other methods of attachment such as using elastic clips, pinching means, screw attachment means, pivoting attachment means or the like to be employed.

Figure 2:
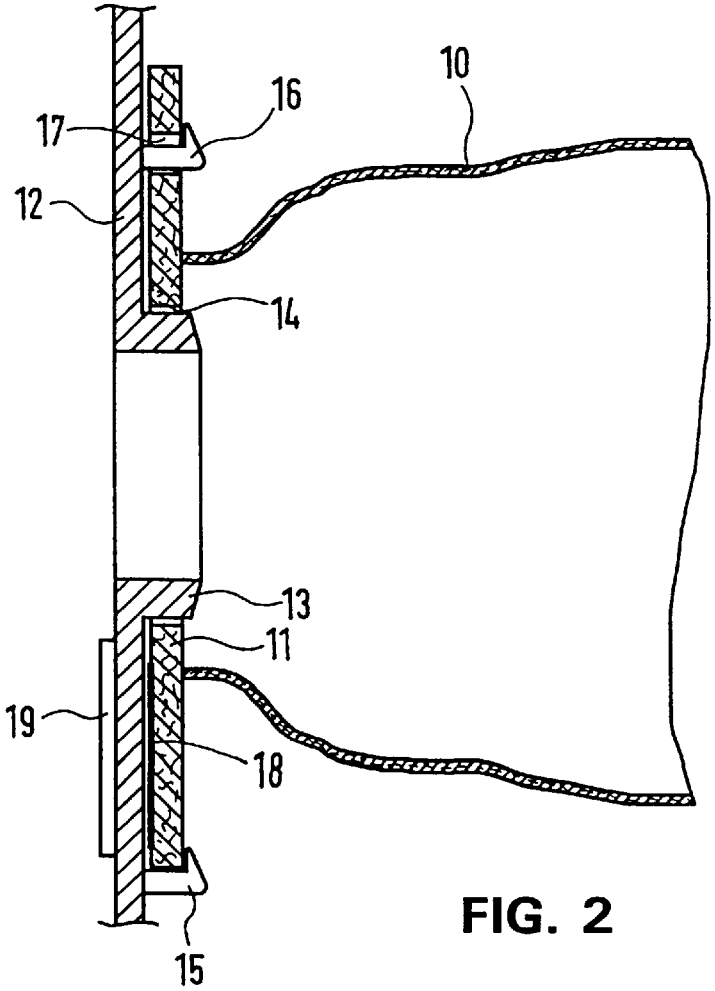
FIG. 2 is a corresponding representation of a filter bag.
Figure 6:
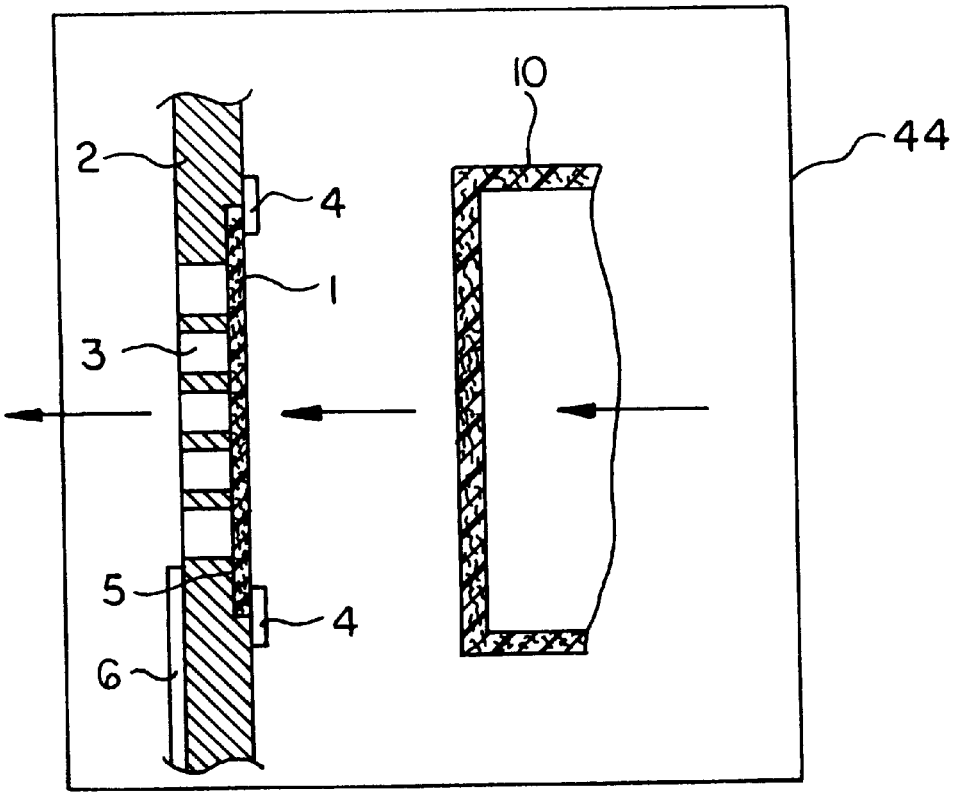
FIG. 6 is a diagrammatic representation of how the filter detector of this invention is incorporated into a vacuum cleaner.

The air drawn in body vacuum cleaner firstly flows in a known manner into a vacuum cleaner bag 10 which is mounted in a space within the housing, as is for example illustrated in FIGS. 2 and 6. Here the coarse dust will remain and the filtered air will leave the vacuum cleaner housing through suitable ducts, not illustrated, to the outside. During such passage it flows through the additional filter 1 in the form of a micro-filter, by which fine impurities, such as spores, germs, pollen and the like are retained to ensure that when the air is returned from the vacuum cleaner it will not cause any allergies or present any other danger to health.

On the edge part of the additional filter 1 metallic foil is placed as a detectable element 5. Instead of a metallic foil it is possible also to provide a metal plate or a metallized layer. On the side of the wall 2 opposite to the additional filter 1 a printed circuit board 6 is arranged adjacent to the detectable element 5, on which printed circuit board an electronic circuit is arranged for detection of the detectable element 5, such circuit being illustrated in FIGS. 3 and 5 for instance and described with reference thereto. The detectable element 5 can more particularly in the case of a multiple layer design of the additional filter 1 be arranged between the layers, that is to say in the interior of the additional filter 1 as well and is then on the one hand protected and on the other hand not able to be seen from the outside.

Instead of a micro-filter as an additional filter 1 it is also possible for example to employ an active carbon filter or filter cassette, which contains a folded, lamella-like material and for example is in the form of an S-class filter. All such filters may be accommodated in board or plastic frames or in board or plastic housings, to which they are bonded for example. It is also possible to employ combination filters, that is to say for instance a filter cassette with an integrated active carbon filter or a combined micro-filter with an active carbon filter. The detectable element can then be arranged on the filter material itself or on the frame or housing. Furthermore it is possible to arrange a plurality of such additional filters in tandem.

The vacuum cleaner bag illustrated in FIGS. 2 and 6 diagrammatically comprises the vacuum cleaner bag 10 in the strict sense, whose wall is manufactured of a material which allows the passage of air but retains dust, and a connection member 11, which is attached preferably by bonding to part of the vacuum cleaner bag 10 having an inlet opening as such.

On a wall 12, illustrated in part of a figure, of the vacuum cleaner 44, for which the vacuum cleaner bag is intended, a bag mounting spout 13 is provided extending into a receiving space for the vacuum cleaner bag, the connection member 11 being slipped over such spout on insertion of the vacuum cleaner bag into the vacuum cleaner so that the connection spout 13 extends through a mounting opening 14 formed in the connection member 11 and extends into the interior of the vacuum cleaner bag. In this manner it is possible for the air drawn in by the vacuum cleaner to pass into the vacuum cleaner bag, in which the dust filtered out of the air by the vacuum cleaner bag wall is retained.

The connection 11 is essentially in the form of a plate and consists of board-like, stiff material. A conventionally present closure slide and a diaphragm seal, conventionally surrounding the mounting opening 34 are not illustrated in order to make the drawing more straightforward and in the case of customary vacuum cleaner bags will not be present anyway. If a closure slide is present the connection member 11 will conventionally have several board layers or plies, as is for instance described and illustrated in German patent publication 4,339,298.

For attachment of the connection member 11 on the wall 12 same possesses a holding rail 15 provided with a receiving groove for an edge part of the connection member 11, such rail being able to be replaced by two suitably shaped holding elements. On the opposite side a detent projection 16 extends through a detent opening 17 on putting the connection member 11 in place and locks the connection member 11. For this purpose it is for instance possible also to have two detent projections 16 and two detent openings 17. In other respects the type of attachment is hardly of any importance for the present invention and may for instance be in accordance with the German patent publication 4,339,297 or other prior art.

On part of the connection member 11 a metallic foil is arranged as a detectable element 18. On the side of the wall 12, which is opposite to the connection member 11 a printed circuit board 19 is arranged operatively adjacent to the detectable element 18 as illustrated in FIG. 1 and on such printed circuit board an electronic circuit is arranged for detection of the detectable element 18. In this respect attention is also called to the explanations on FIG. 1.

In the case of the working embodiment depicted in FIG. 3 as a block circuit diagram the oscillating circuit arrangement 20 is provided for producing electromagnetic waves and it is connected via a rectifying arrangement 21 with a comparator arrangement 22, via which a triac 23 in the power circuit of a vacuum cleaner 24 may be control.

The manner of operation is such that oscillating circuit excited by an excitation switch, not illustrated, of the oscillating circuit arrangement 20 transmits interrogating electromagnetic waves to the outside. The alternating current signals, produced owing to the oscillations in the electronic circuit are rectified in the rectifier arrangement 21 so that a signal will be present at its output, which is dependent on the amplitude of the oscillations. In the comparator arrangement 20 comprising two comparators a check is performed to see whether this signal is smaller than its first threshold value $S_1$ and is simultaneously larger than a second, lower threshold value $S_2$. It is only when these two conditions are fulfilled that the triac becomes is turned on so that the vacuum cleaner motor 24 may be turned by means of a manual switch, not illustrated. The first threshold value $S_1$ is in this respect so set that the output signal of the rectifier arrangement 21 is higher in undamped operation of the oscillating circuit 20 so that the triac 23 is turned off.

If now the additional filter as shown in FIG. 1 or the vacuum cleaner bag in accordance with FIG. 2 is inserted into the vacuum cleaner in the proper fashion, the detectable element 5 or, respectively, 18 will come moved to be operatively adjacent to of the oscillating circuit arrangement 20 and owing to voltages induced in the detectable element 5 or, respectively, 18 eddy currents are produced thereby, which abstract energy from the oscillating circuit and cause damping thereof. The amplitude of oscillation is accordingly reduced so that the output signal of the rectifying arrangement 21 is reduced. The two threshold values $S_1$ and $S_2$ are so set that the damping of the oscillating circuit 20 produced by the detectable element 5 or, respectively, 18 in the correctly mounted state of the additional filter 1 or, respectively, connection member 11 is just sufficient to reduce the output signal of the rectifier arrangement 21 below the upper threshold value $S_1$ but however not below the lower threshold value $S_2$ so that the condition intended is fulfilled and the triac 23 is turned on so that the vacuum cleaner motor 24 may be turned on or operated. In the case of the additional filter 1 being the wrong type or in the case of a connection member 11 without a detectable element 5 or, respectively, 18 or with a detectable element having a smaller area the threshold value $S_1$ the threshold value $S_1$ would not be gone below and the vacuum cleaner could not be operated. If on the other hand the wrong additional filter (or connection member) having an oversize detectable element were to be employed then owing to the greater damping the threshold value $S_2$ would also be gone below so that the vacuum cleaner could again not be operated. It is only an additional filter 1 fitted with the right additional filter 5 that consequently permits operation of the vacuum cleaner. The same will apply for the connection member 11 and the detectable element 5 to the extent here as well a corresponding detection means is provided.

In the case of a simpler design the comparator arrangement 22 could also have but one comparator so that checking would merely be to ascertain whether a detectable element 5 or, respectively, 18 with a certain minimum size is comprised in or on the additional filter 1 or connection member 11. Instead of a triac 23 it would also be possible to employ any other known electrical or electronic switch.

In FIG. 4 the connection member 11 is represented in a diagrammatic plan view. In order to render possible even more reliable recognition of the right vacuum cleaner bag 10 or, respectively, the right connection member 11, on or in this connection member 11 four different detectable elements 25 through 28 are arranged; three detectable elements 25 through 27 in a rectangular form with different areas and one detectable element 28 in the form of a double strip. Assuming that the connection member 11 has been correctly inserted, four oscillating arrangements on the printed circuit board 19 will be opposite to these detectable elements 25 through 28 in a suitable arrangement, such arrangements scanning or checking the respective detectable elements 25 through 28. A fifth oscillating circuit arrangement 33 is not opposite to any detectable element. Each of the oscillating circuit arrangements 29 through 33 is accordingly damped in a particular fashion, the oscillating circuit arrangement 33 not being damped. This is checked in the comparator arrangement which is not illustrated and if in all cases the intended damping values are found, the triac 23 will be turned on. The number and arrangement of the detectable element and oscillating circuit arrangements may naturally be modified to an unlimited extent.

An arrangement as in FIG. 4 may be arranged at one or, if present, more additional filters 1, for instance on the frame or housing of an additional filter as well. The manner of operation is explained with reference to FIG. 4.

In the case of the circuit, represented as a further working embodiment in FIG. 5, for checking for the right additional filter or vacuum cleaner bag or, respectively, connection member a sensor means comprises a transmitted 34 and a receiver 35 for electromagnetic waves. A detectable element 36 to be put on the additional filter 1, is in the form of a micro-chip and also comprises receiver 37 and a transmitter 38 for electromagnetic waves. In addition there is a power supply means 39 for the receiver 37 and the transmitter 38, which is either in the form of a battery or is connected with the oscillating circuit of the receiver 37 and obtains the supply power from the RF energy received in the oscillating circuit, as is disclosed for example in the German patent publication 4,110,683.

In the receiver 37 or in the transmitter 38 a converter is comprised by which the received signal is changed. This changed signal is then transmitted back by the transmitter 38 of the detectable element 36 to the receiver 35 of the detectable sensor means. Conversion may for instance be performed by changing the frequency or the phase relationship of the RF signal. As an alternative to this it is also possible for the re-transmitted signal to be modulated in a predetermined fashion so that a certain code is transmitted to the receiver 35 of the sensor means. The signal received in the receiver 35 is then checked in a decoder 40 to see whether the intended information of the detectable element 36 is contained in it. If this is the case the decoder 40 will turn on the triac 23. Further possibilities of encoding the signal and re-transmission by detectable elements 36 in the form of microchips are disclosed in the said German patent publication 4,110,683.

Figure 7:
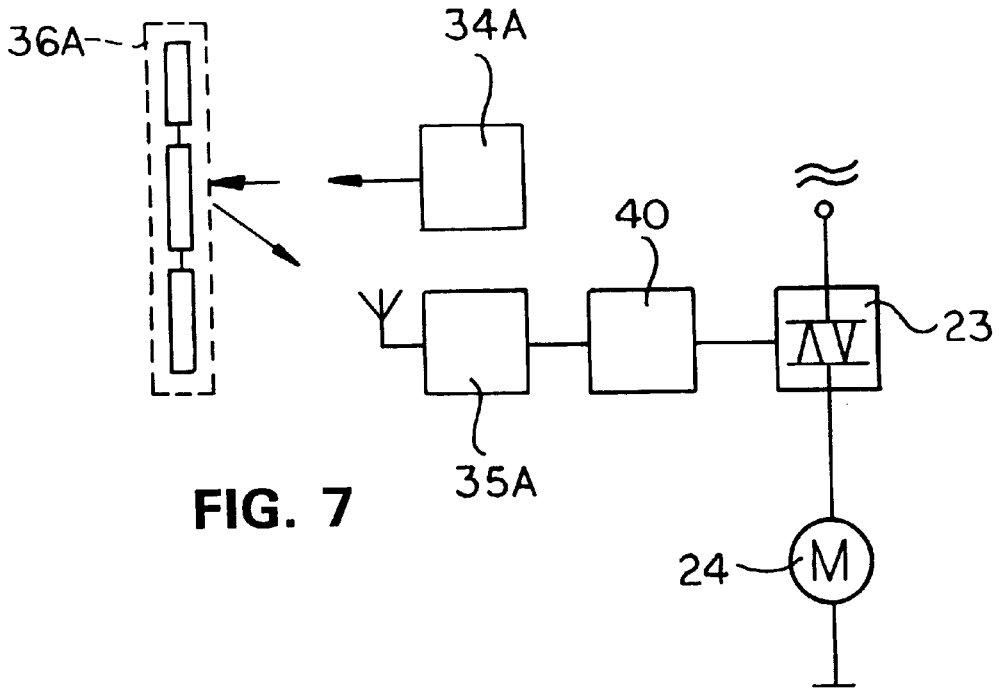
FIG. 7 is a view similar to FIG. 4 but showing the light transmitter, light deflecting element, and light receiver.

A further alternative possibility is one in which the transmitter for electromagnetic waves is designed in the form of a light transmitter 34A and the receiver for electromagnetic waves in the form of a light receiver 35A (FIG. 7). As a detectable element 36A it is then possible to have a barcode or another means, which shines back the light in a changed or unchanged form to the light receiver 35A of the sensor means. For instance a deflecting element in the detectable element a light guide may be provided, which guides back the light received at one point from the sensor means to an another point to the additional filter or, respectively, connection member, on which the light receiver is arranged.

A further alternative arrangement is one using capacitive detection of the detectable element. In this case it is possible again for the detectable element to be in the form of a conductive plate or, respectively, metallic sheet element, which constitutes a part of a capacitor of a measuring oscillating circuit.

The circuits illustrated in FIGS. 3 and 5 as embodiments, which comprise sensor means and evaluating means, may be comprised on the printed circuit board 6 or, respectively, 19 as integrated or non-integrated circuit. In this respect it is for example also possible to design the entire circuit completely or partially in the form of an integrated circuit or in the case of there being a plurality of detectable elements at different points a plurality of printed circuit boards or other sensor means may be provided.

As a modification of FIG. 2 it is also possible for a detectable element or a plurality of detectable elements to be placed on the vacuum cleaner bag 10 as such, which during operation normally lies against the surface of the walls of a vacuum cleaner bag space in the vacuum cleaner. Then the printed circuit board 19 and/or an integrated sensor and evaluating circuit may then be arranged on such walls. It is also possible to employ combined designs, in the case of which some detectable elements are provided on the vacuum cleaner bag 10 as such and some are arranged on the connection member 11. This is also possible for additional filters.

What is claimed is:

1. A detector assembly for sensing if a filter element is properly mounted to a vacuum cleaner, the vacuum cleaner having a motor, said detector assembly comprising:

a sensor connected to the vacuum cleaner to detect the presence of the filter element by transmitting interrogating signals to determine the presence of at least one detectable element integral with the filter element, said sensor producing a sensor output signal that varies based on the presence, type and position of the detectable element;

a processing circuit for receiving said sensor output signal, said processing circuit configured to evaluate said sensor output signal to determine if the sensor output signal indicates said sensor has detected the presence of a select type of detectable element in a select position and, if the detection occurs, to assert a switch-on signal; and a switch for receiving said switch-on signal from said processing circuit, said switch being connected to the motor for regulating actuation of the motor, wherein said switch prevents actuation of the motor unless said switch-on signal is received.

2. The detector assembly according to claim 1, wherein a vacuum cleaner bag includes a detectable element, and the sensor is additionally responsive to said detectable element of the vacuum cleaner bag for checking the presence, type and position thereof.

3. The detector assembly according to claim 2, wherein said vacuum cleaner bag includes a connection member having said detectible element of said vacuum cleaner bag mounted thereto.

4. The detector assembly according to claim 1, where the sensor, the processing circuit, and the switch are integrally formed on one structural unit, said structural unit being one of a printed circuit board and an integrated circuit.

5. The detector assembly according to claim 4, wherein the vacuum cleaner includes a housing, and the structural unit is arranged in or on a wall surface of the vacuum cleaner housing operatively adjacent to the at least one detectable element.

6. The detector assembly according to claim 5, wherein the wall surface having the structural unit thereon is arranged essentially adjacent to the at least one detectable element.

7. The detector assembly according to claim 1, wherein the sensor includes an oscillating circuit for producing said interrogating signal.

8. The detector assembly according to claim 7, wherein the sensor includes means for capacitively detecting the detectable element.

9. The detector assembly according to claim 7, comprising a plurality of said detectable elements arranged on or in the at least one additional filter, and the vacuum cleaner bag including at least one said detectable element, said elements being adapted to be sensed by parts of the sensor.

10. The detector assembly according to claim 7, wherein the detectable element is a metallic plate, and wherein the sensor is configured to produce the sensor signal as a function of eddy current effect-induced damping of the interrogating signals by said metallic plate.

11. The detector assembly according to claim 10, wherein the processor receives said sensor signal representing a certain amplitude of oscillation of said interrogating signal produced by the oscillating circuit that represents the presence of said detectable element.

12. The detector assembly according to claim 11, wherein said sensor produces a variable amplitude oscillating sensor signal, and said processor includes an evaluating circuit for comparing said sensor signal to an adjustable first threshold value and, when the sensor signal is above said first threshold value, preventing the switching on of the vacuum cleaner motor.

13. The detector assembly according to claim 12, wherein, when said sensor signal is under a second adjustable threshold value, said evaluating circuit prevents switching on of the vacuum cleaner motor.

14. The detector assembly according to claim 7, wherein said detectable element comprises means for retransmission of signals modified in relation to electromagnetic said interrogating signals received from said transmitter and wherein the sensor possesses a corresponding receiving means for receiving the modified signals.

15. The detector assembly according to claim 14, wherein the modified signals from said detectable element are changed in at least one of frequency and phase.

16. The detector assembly according to claim 14, wherein the modified signals are modulated.

17. The detector assembly according to claim 14, wherein the modified signals comprise a signal code.

18. The detector assembly according to claim 14, wherein said detectable element modifies the interrogating signal in a predetermined manner, and the processing circuit includes recognition means for analyzing the modified signal.

19. The detector assembly according to claim 14, wherein the detectable element is a micro-chip.

20. The detector assembly according to claim 1, wherein the sensor includes a light transmitter for transmitting an optical said interrogating signal to said detectable element and a light receiver receiving a reflected said optical interrogating signal from said detectable element.

21. The detector assembly according to claim 20, wherein the detectable element is one of a barcode and a deflecting element returning the light unchanged or changed to a particular point on the sensor.

22. The detector assembly according to claim 1, wherein the at least one additional filter is one of a micro-filter, a filter cassette, an active carbon filter, and combined filter.

23. A vacuum cleaner comprising:

a housing defining a space for receiving a filter bag, said housing having a wall, said wall formed with an opening configured to received a filter element adjacent the opening for filtering air flowing through the opening;

a connection spout mounted to said housing for coupling into an open end of the filter bag;

a motor which is selectively energized to cause air flow through said connection spout into the filter bag and through the opening; and a detector assembly for sensing if the filter element is properly mounted to said housing wall, said detector assembly including:

a sensor connected to said housing to detect the presence of the filter element by transmitting electromagnetic waves to determine the presence of a detectible element integral with the filter element and that produces a sensor output signal that varies based on the presence, type and position of the filter element detectible element;

a processing circuit for receiving the sensor output signal, said processing circuit configured to evaluate the sensor output signal to determine if the sensor output signal indicates said sensor has detected the presence of a select type of filter element detectible element in a select position and, if the detection occurs, to assert a switch-on signal;

a switch for receiving the switch-on signal from said processing circuit and that is connected to said motor for regulating actuation of said motor, wherein said switch prevents actuation of said motor unless the switch-on signal is received.

24. A vacuum cleaner filter assembly comprising:

a filter element configured to be mounted to a wall of a vacuum cleaner for filtering air discharged from the vacuum cleaner; and a detecting member secured to said filter element, said detecting member being a planar metal member and configured to cause the transmission of distinct electromagnetic waves upon receiving an interrogating electromagnetic waves.

25. A vacuum cleaner filter assembly comprising:

a filter element configured to be mounted to a wall of a vacuum cleaner for filtering air discharged from the vacuum cleaner; and a detecting member secured to said filter element, said detecting member being configured to cause the transmission of distinct electromagnetic wave upon receiving an interrogating electromagnetic wave, said detecting member including a transmitter for broadcasting information indicating the type of filter assembly.

26. A vacuum cleaner filter assembly comprising:

a filter element configured to be mounted to a wall of a vacuum cleaner for filtering air discharged from the vacuum cleaner; and a detecting member secured to said filter element, said detecting member being a planar metal member and configured to cause the transmission of a distinct detection signal upon receiving an interrogating signal.

* * * * *